US005305497A

United States Patent [19]

Liverani et al.

[11] Patent Number: 5,305,497

[45] Date of Patent: Apr. 26, 1994

[54] METHOD TO SEPARATE POLYPROPYLENE IN THE PROCESSING OF SILK AND DEVICE TO SEPARATE POLYPROPYLENE WHICH EMPLOYS SUCH METHOD

[75] Inventors: Cesare Liverani, Tarcento; Gianvittore Valent, Caneva di Tolmezzo; Paolo Viciguerra, Rivignano, all of Italy

[73] Assignee: Cascami Seta-Filature Seriche Riunite SpA, Vallemosso, Italy

[21] Appl. No.: 976,514

[22] Filed: Nov. 13, 1992

[30] Foreign Application Priority Data

Nov. 15, 1991 [IT] Italy ..... UD91A000191

[51] Int. Cl.[5] ..... D01B 9/00; B30B 15/34; B07B 15/00

[52] U.S. Cl. ..... 19/66 R; 100/93 RP; 209/11; 15/256.52

[58] Field of Search ..... 19/66 R, 66 CC, 66 T, 19/66.2, 65 R, 65 CR; 100/38, 93 RP, 93 P; 209/11; 15/256.52

[56] References Cited

U.S. PATENT DOCUMENTS 1,565,196 12/1925 Piana .
3,763,778 10/1973 Sills et al. ..... 15/256.52 X
4,334,468 6/1982 Güttinger et al. ..... 100/93 RP
4,718,843 1/1988 Carlsson et al. ..... 100/93 RP X
5,061,735 10/1991 Zielinski ..... 209/11 X
5,091,753 2/1992 Slapelis ..... 15/256.52 X

FOREIGN PATENT DOCUMENTS 0344729 5/1989 European Pat. Off. .
4966 9/1905 France .
83693 8/1964 France ..... 19/66 R

*Primary Examiner*—Clifford D. Crowder
*Assistant Examiner*—John J. Calvert
*Attorney, Agent, or Firm*—Antonelli, Terry, Stout & Kraus

[57] ABSTRACT

Method to separate polypropylene in the processing of silk schappe, whereby a lap (14) of silk fibers which are partly combed or are at least made sufficiently parallel undergoes an action of heating between 110° C. and 160° C. together with a simultaneous action of controlled compression so as to form clusters of polypropylene and silk fibers and thereafter an action of combing or pre-combing for the definitive removal of those clusters of polypropylene and silk fibers.

Device to separate polypropylene in the processing of silk schappe, which is positioned downstream of a drawing frame (13) or analogous machine producing a lap (14) of silk fibers, the device including a conveyor means (belt/drum) cooperating with means that heat and apply adjustable pressure to the lap (14).

20 Claims, 2 Drawing Sheets

METHOD TO SEPARATE POLYPROPYLENE IN THE PROCESSING OF SILK AND DEVICE TO SEPARATE POLYPROPYLENE WHICH EMPLOYS SUCH METHOD

BACKGROUND OF THE INVENTION

This invention concerns a method and device to separate polypropylene in the processing of silk.

To be more exact, this invention concerns a method and separator device able to separate manmade fibres, and polypropylene fibres in particular, from silk schappe, that is to say, pure silk of discontinuous fibres coming from waste silk.

It is known that during recent years the old packages based on cellulose in which waste silk was conveyed from its collection points to its places of recovery and re-use have been replaced with packages containing manmade fibres and, in particular, polypropylene fibres.

The technology of the state of the art has already found a system for eliminating the cellulose fibres from the silk schappe but is powerless to do so in the case of manmade fibres.

This position entails the shortcoming that the fibres of polypropylene or other manmade materials impair the silk fibres, but the presence of these manmade fibres cannot be identified at present by any method other than dyeing.

Indeed, the only existing system to identify the polypropylene fibres is to dye the silk since the polypropylene fibres possess no affinity to dyes and remain white.

These undyed polypropylene fibres lead to an end product of an unacceptable quality, and these rejects containing polypropylene fibres cause a great increase in the production costs of the silk free of defects precisely owing to the subsequent elimination of such defects.

U.S. Pat. No. 1,565,196 discloses the purifying of silk from extraneous products such as wooden chips, leaves and straw. These products are visible and do not entail the problems of separation and purification caused by polypropylene.

In any event the method disclosed cannot be used and in fact makes the silk containing the impurities pass into an oven so that the impurities are dried, and then passes the whole mixture into a crusher, so that the impurities are removed in the form of a powder.

EP-A-0.344.729 too is not acceptable because it concerns cotton and because it proposes to remove the sugar which the insects deposit on the cotton flower and then to caramellize and pulverize the sugar.

SUMMARY OF THE INVENTION

The present applicants have studied, tested and accomplished this invention so as to overcome the shortcomings of the state of the art and to achieve further advantages.

The purpose of this invention is to identify and eliminate any manmade fibres and, in particular, polypropylene fibres mixed with discontinuous silk fibres coming from waste silk.

The device to separate the polypropylene according to the invention is fed with a lap of silk consisting of fibres which are at least semicombed or at least made sufficiently parallel.

The lap of silk fibres in the device to separate the polypropylene according to the invention is therefore heated to a temperature between 110° C. and 160° C., and advantageously between 120° C. and 140° C., and is compressed at the same time to a desired value.

According to one idea of the solution that lap of silk fibres is conveyed on a conveyor belt.

According to a variant the lap of silk fibres is conveyed on a first lower conveyor belt, while a second upper conveyor belt facing the first conveyor belt controls the lap itself.

At least the facing surfaces of the conveyor belts, or the surface of the single conveyor belt, consist of a material which substantially does not adhere readily to the softened polypropylene.

According to another idea of the solution the lap of silk fibres is conveyed on a rotary drum. In fact, it has been found that the formation of clusters of polypropylene and silk fibres is assisted by exerting a pressure comprised substantially between 0.1 kg/cm$^2$ and 5 kgs/cm$^2$ during the heating step.

The pressure can be exerted on the lap of silk fibres substantially along its whole travel in the separator device or only along a determined segment, for instance after the manmade material has already reached a required temperature.

Any polypropylene fibres within the lap of silk, in fact, soften and create clusters together with the neighbouring silk fibres.

A part of these clusters is removed, while still inside the separator device according to the invention, by appropriate cleaning means.

The lap, while still in the form of a lap or when compressed, then undergoes a combing action in a successive combing or pre-combing step, in which the remainder of the clusters is removed.

BRIEF DESCRIPTION OF THE DRAWINGS

The attached FIGURE which is given as a non-restrictive example, shows a preferred embodiment of the invention.

DESCRIPTION OF THE PREFERRED EMBODIMENTS

Figure 1:
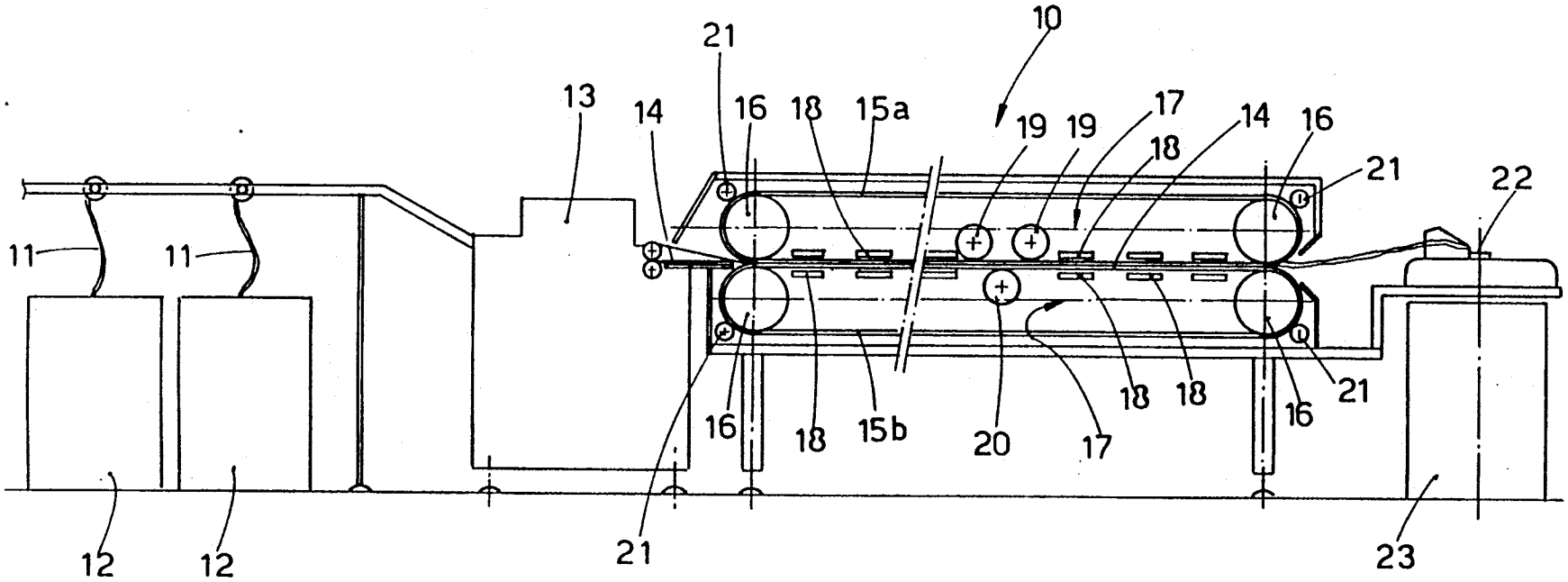
Figure 2:
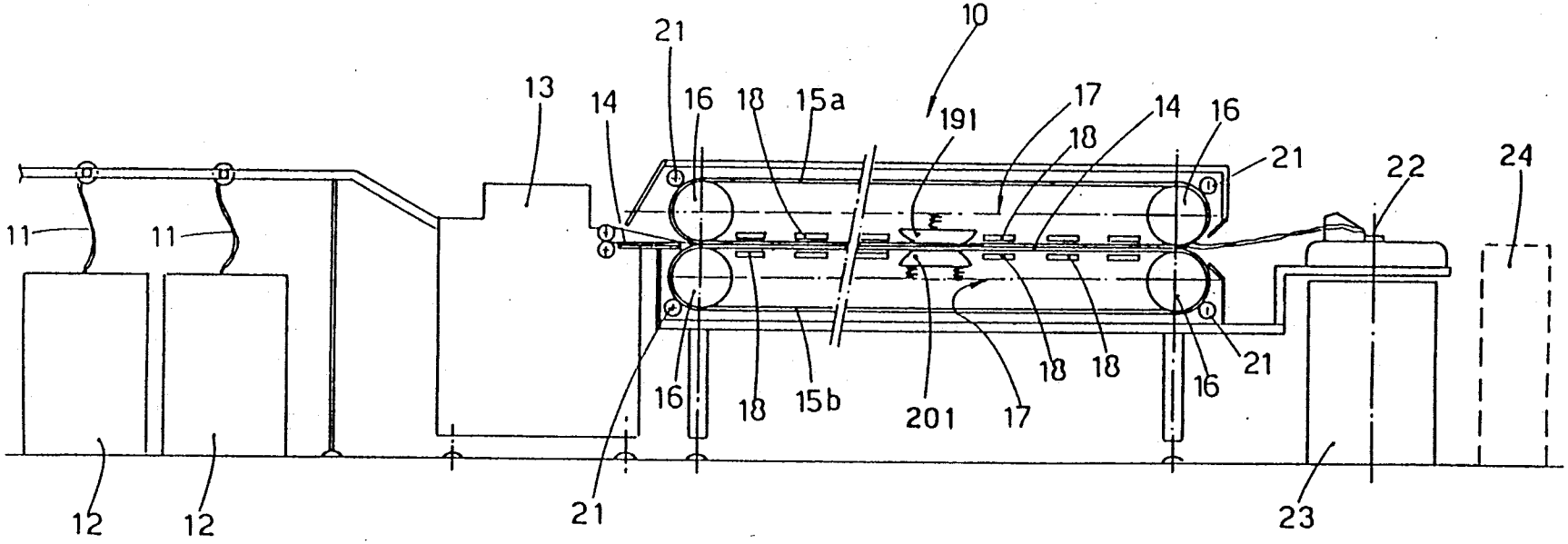

The FIGURE shows diagrammatically a known plant for the treatment of silk schappe, in which a device to separate polypropylene according to the invention is included.

In the figure the reference number 10 indicates generally a device to separate polypropylene according to the invention.

In this case a plurality of slivers 11 of silk fibres including impurities such as manmade fibres and, in particular, polypropylene fibres and coming from cans 12 is fed to a drawing frame 13 of a known type.

The drawing frame 13 has the task of coupling and making parallel the fibres constituting the slivers 11 so as to form a lap 14 of fibres made sufficiently parallel.

The lap of fibres 14 thus produced is fed to the polypropylene separator device 10 according to the invention, which in this case comprises two endless, rotary, parallel and opposed steel belts **15*a*–15*b***.

According to a variant the belts **15*a*–15*b*** consist of a heat-resistant material which does not become readily fixed to softened polypropylene.

According to a further variant the belts **15*a*–15*b*** consist of steel coated with an abrasion-resistant material which is resistant also to heat.

The steel belts **15*a*–15*b* are coated advantageously with Teflon or another suitable material resistant to abrasion and to heat and having the purpose of preventing the silk lap 14 and polypropylene clusters from sticking to the steel belts 15***a*–15*b*.

The belts 15*a*–15*b* are kept respectively under tension and are driven in a coordinated manner by drawing wheels 16.

The steel belts 15*a*–15*b* are heated to a temperature between 110° C. and 160° C., and advantageously between 120° and 140° C., by suitable heaters 17 consisting in this case of a plurality of electrical resistors 18 arranged along the whole length of the belts 15*a*–15*b*.

Other adjustable sources of heat such as heating plates, gas burners, etc. can be used as desired instead of the electrical resistors 18.

The heating causes softening of any manmade fibres included within the silk lap 14, and those fibres expand and form clusters together with the neighbouring silk fibres.

The lap 14 of silk fibres passing between the two steel belts 15*a*–15*b* undergoes a required pressure, which can also be regulated as desired during the above heating step.

The pressure is kept substantially between 0.1 kg/cm$^2$ and 5 kgs/cm$^2$ and assists the formation of clusters of polypropylene and fibres.

In this example the pressure exerted between the two steel belts 15*a*–15*b* is applied by pairs of pressure rolls 19 cooperating with the upper steel belt 15*a*; these pairs of pressure rolls 19 are opposed by contrast rolls 20 cooperating with the lower steel belt 15*b*.

The rolls 19 and/or 20 may be positioned along the whole length of cooperation of the belt 15*a* with the the belt 15*b* or only along a required segment of that length.

In this example the pressure exerted by the steel belts 15*a*–15*b* is adjusted by distancing or bringing closer the upper pressure rolls 19 from or to the lower contrast rolls 20 by known means.

In this case the upper and lower rolls 19–20 are advantageously installed at a median position of the length of the steel belts 15*a*–15*b*, and the pressure exerted by the rolls 19–20 is distributed substantially along the whole length of the steel belts 15*a*–15*b*.

The upper and lower rolls 19–20 or other suitable means such as slide shoes or other means again are placed along the length of the opposed steel belts 15*a*–15*b* and are kept at a constant pressure or a controlled or adjustable pressure.

According to a variant cleaning brushes 21 cooperate with the outer mating surfaces of the belts 15*a*–15*b* and clean from those steel belts 15*a*–15*b* a part of the clusters of polypropylene and fibres produced by the heating and also any impurities adhering to the belts 15*a*–15*b*.

The lap 14 leaving the polypropylene separator device 10 is compressed, and compressed lap 22 leaving the device 10 is collected in a can 23 and thereafter undergoes combing or pre-combing according to the state of the art.

The clusters formed within the separator device 10 are removed partly within the device 10 by the cleaning brushes 21 and partly during the subsequent combing or pre-combing steps.

We claim:

1. A method to separate polypropylene impurity fibres in the processing of silk schappe, comprising providing a lap of sufficiently parallel silk fibres, heating said lap between 110° C. and 160° C. compressing said lap so as to form clusters of polypropylene and silk fibre and thereafter combing or pre-combing the lap for removal of said clusters of polypropylene and silk fibres.

2. A separator device to separate polypropylene impurity fibres in the processing of silk schappe, which is positioned downstream of a machine producing a lap of silk fibres, said separator device comprising a conveyor means and pressure means for heating and applying adjustable pressure to the lap being conveyed by said conveyor means.

3. A separator device as claimed in claim 2, wherein the conveyor means consists of a belt/drum and the pressure means consist of slide shoes which are heated and pressed against each other.

4. A separator device as claimed in claim 2, wherein conveyor means and the pressure means consist of two contrarotating opposed endless belts which are heated and pressed against each other.

5. A separator device as claimed in claim 2, wherein the conveyor means and the pressure means have at least their facing sides consisting of a material resistant to abrasion, to heat and substantially to the adhering of softened polypropylene.

6. A separator device as claimed in claim 3, wherein said pressure means controls a temperature of heating of the lap of silk fibres to between 110° C. and 160° C.

7. A separator device as claimed in claim 4, wherein the opposed sides of the belts cooperate with cleaning brushes.

8. A separator device as claimed in claim 7, wherein the pressure means controls the pressure exerted on the lap of silk fibres to between 0.1 kg/cm$^2$ and 5 kgs/cm$^2$.

9. A separator device as claimed in claim 3, wherein said pressure means includes electrical resistors for the heating of the silk fibres.

10. A separator device as claimed in claim 2, wherein said machine for producing a lap of silk fibres is a drawing frame.

11. A method as claimed in claim 1, wherein said lap of sufficiently parallel silk fibres is partly combed.

12. Separator device as claimed in claim 4, in which the temperature of the heating of the lap of silk fibers is kept between 110° C. and 160° C.

13. Separator device as claimed in claim 4, in which the heating of the silk fibres is carried out by means of electrical resistors.

14. A plant for the treatment of silk schappe, comprising:

a source of slivers of silk fibres including polypropylene impurity fibres;

a machine for producing a lap of said silk fibres;

a separator device to separate said polypropylene impurity fibres from said lap, said separator device comprising a conveyor means and pressure means for heating and applying adjustable pressure to the lap being conveyed by said conveyor means; and means for combing the lap processed through said separator device.

15. A plant as claimed in claim 14, wherein said machine for producing a lap of silk fibres is a drawing frame.

16. A plant as claimed in claim 14, wherein the conveyor means consists of a belt drum and the pressure means consist of slide shoes which are heated and pressed against each other.

17. A plant as claimed in claim 14, wherein the conveyor means and the pressure means consist of two contrarotating opposed endless belts which are heated and pressed against each other.

18. A plant as claimed in claim 14, wherein the conveyor means and the pressure means have at least their facing sides consisting of a material resistant to abrasion, to heat and substantially to the adhering of softened polypropylene.

19. A plant as claimed in claim 14, wherein said pressure means controls a temperature of heating of the lap of silk fibres to between 110° C. and 160° C.

20. A plant as claimed in claim 14, wherein the opposed sides of the belts cooperate with cleaning brushes.

* * * * *